United States Patent [19]

Howitt

[11] Patent Number: 5,027,961

[45] Date of Patent: Jul. 2, 1991

[54] STACKABLE SHELF DOCUMENT STORAGE APPARATUS

[75] Inventor: Robert Howitt, Leominster, Mass.

[73] Assignee: Curtis Manufacturing Company, Inc., Jaffrey, N.H.

[21] Appl. No.: 521,225

[22] Filed: May 7, 1990

Related U.S. Application Data

[63] Continuation-in-part of Ser. No. 468,821, Jan. 22, 1990.

[51] Int. Cl.[5] ..... A47F 5/00

[52] U.S. Cl. ..... 211/188; 211/194; 312/108

[58] Field of Search ..... 211/188, 194; 312/108, 312/107

[56] References Cited

U.S. PATENT DOCUMENTS 4,469,231 9/1984 Hehn ..... 211/188 X
4,681,378 7/1987 Hellman, III ..... 211/188 X

FOREIGN PATENT DOCUMENTS 261317 4/1949 Switzerland ..... 211/188
524898 8/1940 United Kingdom ..... 211/188

*Primary Examiner*—Alvin C. Chin-Shue
*Assistant Examiner*—Sarah A. Lechok
*Attorney, Agent, or Firm*—Richard P. Crowley

[57] ABSTRACT

A modular stackable shelf storage apparatus for stacking with other units with a top shelf providing a base for mounting a facsimile machine, wherein a body unit is adapted to be interlockably stacked together with the units to provide segregated shelf spaces for storing documents such as are produced by a facsimile machine, the body unit having a flat top surface, first and second sides and an open front to define an open space within the body unit including a centrally disposed hollow finger serving as a space divider and as a mounting device; whereby in stacking two or more units together a firm base mount is provided for a facsimile machine and a plurality of shelf storage spaces are provided for segregated storage of documents.

14 Claims, 2 Drawing Sheets

STACKABLE SHELF DOCUMENT STORAGE APPARATUS

REFERENCE TO PRIOR APPLICATION

This application is a continuation in part of U S. Pat. No. Design application S.N. 07/468,821, filed Jan. 22, 1990, which is incorporated herein by reference.

BACKGROUND OF THE INVENTION

The introduction of facsimile document producing machines in modern offices already crowded with computer related equipment, for example wor processors, monitors, keyboards and printers, has created two additional separate and distinct space demands on the office, i.e. space for the facsimile machine and space for the documents produced. The facsimile machine to operate must be connected by a telephone cable line to a telephone outlet located in the office, thereby limiting its location to a position relatively near the telephone outlet. Furthermore, inasmuch as a facsimile machine includes complex and fragile circuitry and has greater weight than a telephone, it should be placed in a well supported stand or table for mounting for it cannot withstand the shock of being dropped, as most telephones can. It is for this reason that the typical telephone stand has not proven satisfactory as a facsimile machine stand. Rather the facsimile machine requires a new more stable stand constructed for adequate support.

Of equal significance to space planning, the facsimile machine is adapted to produce a large quantity of documents requiring prompt attention by a plurality of recipients having differing local addresses and differing subject matter which should be segregated upon receipt, for example separated by client, subject matter, content, recipient, sender, etc. Furthermore, the typical facsimile paper is itself very supple and bends readily requiring adequate storage lest it be damaged. When facsimile machines were first introduced it was common to have the output of the facsimile machines pile up in bins or in heaps on the floor to be picked up and segregated at various intervals. This has not proved an effective manner of handling the receipt of what should be considered priority electronic mail. Facsimile transmissions, furthermore, being high priority documents should receive the immediate attention of the recipient, and therefore place special demands on prompt and early segregation of the documents such that the recipient will be able to identify the incoming documents to deal with them in a timely manner. Heretofore, standard document holders used to hold incoming mail have had open tops, two or more sides and a base. Such storage device requires individual space in addition to that required for the facsimile machine. Therefore, it is desirable to provide for a compact, simple shelf document storage apparatus which provides for storage for documents and a mount for a facsimile machine.

SUMMARY OF THE INVENTION

This invention relates to a modular stackable shelf storage apparatus for stacking with other units with a top shelf adapted to provide a stable platform for mounting purposes. In particular the invention concerns a stackable shelf storage apparatus providing a base for mounting a facsimile machine.

The invention relates to an improved modular stackable shelf storage apparatus including a body unit adapted to be interlockably stacked together with other units to provide shelf spaces for storing documents, such as documents produced by a facsimile machine. The stackable shelf storage apparatus comprises a body unit having a generally flat top surface, and first and second short sides, an open back and an open front, to define an open space within the body unit including a centrally disposed hollow finger.

The top surface of the body unit having a front and back is provided with a plurality of elongated grooves comprising a right hand and a left hand groove at the intersections of the top surface and the first and second sides. The grooves are angled and formed to extend inwardly having a horizontal side and a vertical side for receiving fingers extending from the first and second short sides of the next higher body unit for interlocking engagement therewith. The top surface is also provided with an elongated slot having a transverse orientation disposed intermediate to the elongated groove, the slot being formed by the downwardly extending hollow finger. The elongated slot is adapted to receive the hollow finger of the next higher body unit for interlocking engagement therewith, with the hollow finger of the next higher unit forming a plurality of document storage receiving areas having a shelf like base formed by the top surface of the next lower body unit.

The front of the top surface is also provided with a plurality of indents for affixing an identification label and a plurality of access recesses for providing access for a users thumb and forefinger to readily insert and remove documents in and from the storage receiving areas.

The elongated slot includes a plurality of cross braces positioned such that the top surface of the cross braces is co-planar with the horizontal sides of the grooves in the top surface to provide a form mount for the hollow finger of the next higher body unit and for mounting the fingers of the first and second short sides. Interlocking of a body unit with a next unit is accomplished by the interaction of the vertical side of the groove with the inner surface of the finger and the outer surface of the hollow finger with the peripheral annular surface of the elongated groove.

Provided in the body unit the first and second downwardly extending short sides have elongated downwardly extending side fingers having a width less than the width of the sides and downwardly extending finger elements extends downwardly a distance equal to the distance of the downwardly extending central finger elements so that if the shelf storage unit is placed on a flat surface the storage unit is firmly supported. The body unit is adapted to be used individually to provide a top shelf for a placement of a facsimile apparatus or facsimile document producing apparatus and a plurality of letter sized document receiving spaces; when used individually spaces would total two spaces. Alternatively the body unit is adapted to be interlockably and stackably together with other body units to provide a top shelf for placement of the facsimile apparatus or other document producing apparatus and to provide a plurality of stacked letter sized document receiving spaces beneath the top shelf. The top shelf is of substantial width as extending over the document receiving spaces each space having a width sufficient to accept an 8½" wide document such that a large variety of different sized facsimile machines may be mounted thereon.

The body unit includes a short downwardly extending hollow finger oriently transversely to the longitudinal axis of the body unit and in parallel relationship with the elongated grooves and extending across substantially all of the top shelf and extending downwardly a distance equal to the distance equal to the length of the short side units so that the storage shelf may be placed on a flat surface and be firmly supported. The body unit is constructed of rigid molded plastic construction adapted to support the weight of the facsimile machine without the risk of damage resulting from being tipped over.

The invention will be described for the purposes of illustration only in connection with certain embodiments; however, it is recognized that those persons skilled in the art may make various changes, modifications, improvements and additions on the illustrated embodiments all without depart from the spirit and scope of the invention.

DESCRIPTION OF THE EMBODIMENTS

Figure 1:
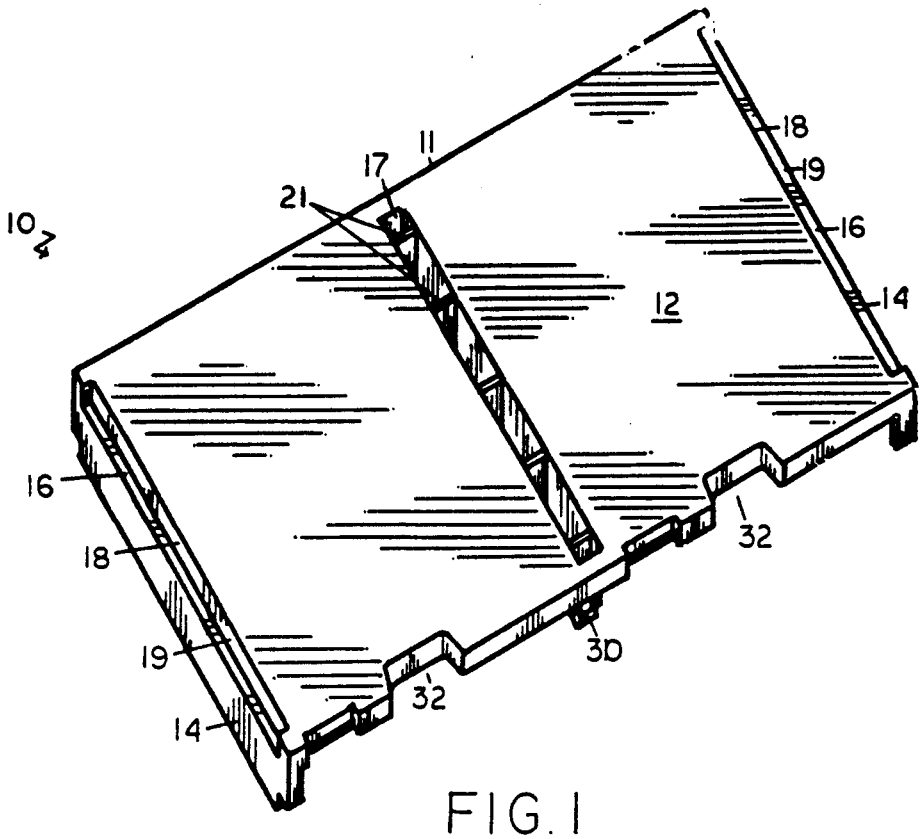
FIG. 1 is a perspective view from above of the stackable shelf document storage apparatus of the invention.
Figure 2:
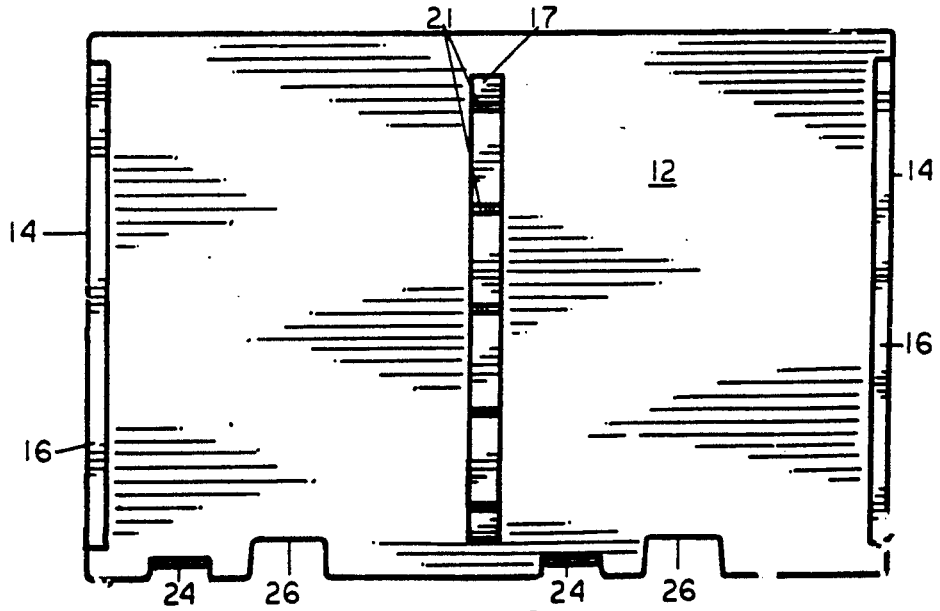
FIG. 2 is a top plan view of the invention of FIG. 1.

FIG. 1. is a perspective view of a unitary body unit 10 of the shelf storage apparatus 11, showing the generally flat top surface 12, first and second short sides 14, and as shown in FIGS. 2,3,4,5 & 6, extending downwardly from the flat top surface 12 to define an open space 15 within the body unit 10, with angled grooves 16 at the intersection of the flat top surface 12 and the first and second short sides 14, extending inwardly. The angled grooves 16 extend in a transverse orientation relative to the longitudinal axis of the body unit 10, and have vertical sides 18 and horizo sides 19.

Figure 3:
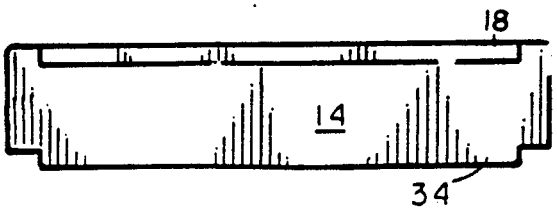
FIG. 3 is a side elevational view of the apparatus of the invention of FIG. 1, the other side being the same.
Figure 4:
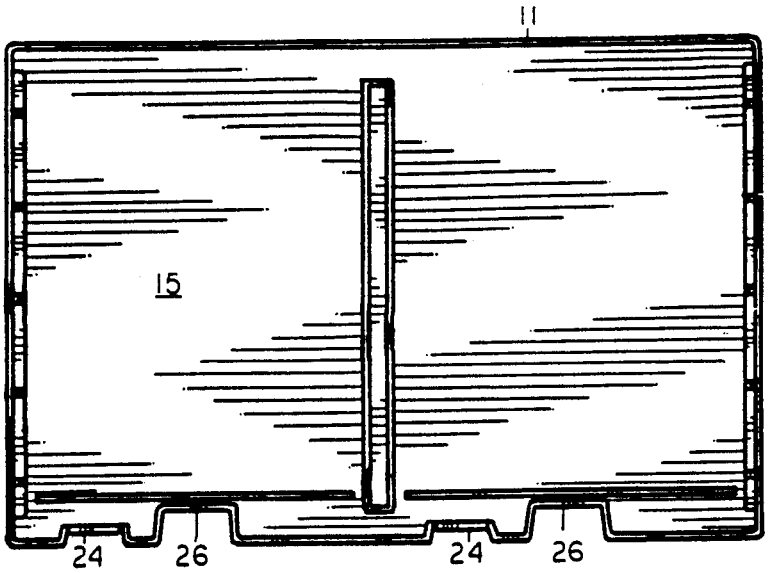
FIG. 4 is a bottom plan view of the apparatus of the invention of FIG. 1.

As illustrated in FIG. 3, the first and second sides 14 are provided with elongated side finger elements 34 of less width than the sides adapted to fit into the elongated inwardly extending grooves of the next lower body unit 10 in interlocking relationship.

Figure 5:
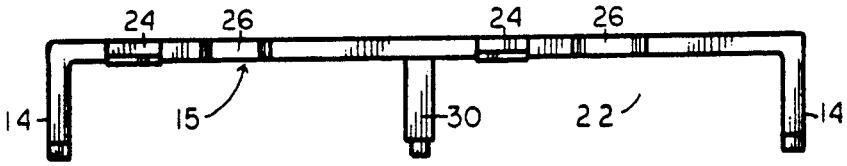
FIG. 5 is a front elevational view of the apparatus of the invention of FIG. 1.
Figure 6:
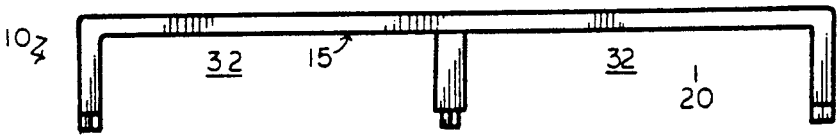
FIG. 6 is a back elevational view of the apparatus of the invention of FIG. 1.

As shown in FIGS. 1 through 6, the body unit 10 is of molded construction, typically of lightweight plastic material. As shown in FIG. 6., the body unit 10 is constructed with an open back 20, and as shown in FIG. 5 an open front 22 and defines the open space 15 within the body unit 10. A short hollow finger 30 having a transverse orientation to the longitudinal axis of the body unit 10 is positioned in the mid section of the flat top surface 12 extending downwardly a distance equal to the length of the short sides 14 for providing a mounting element and thereby dividing the open space 15 into a plurality of document receiving storage spaces 32 adjacent the open front 22. Also included in the top surface 12 is an elongated slot 17 formed by the hollow finger 30 having a plurality of transverse struts 21 and extending substantially across the width of the top surface 12. The front 22 is provided with a plurality of indents 24 for receiving identification labels chosen by the user and a plurality of access slots 26 positioned centrally in each storage space 32 to permit the user to insert documents into the space and retrieve them therefrom.

Figure 7:
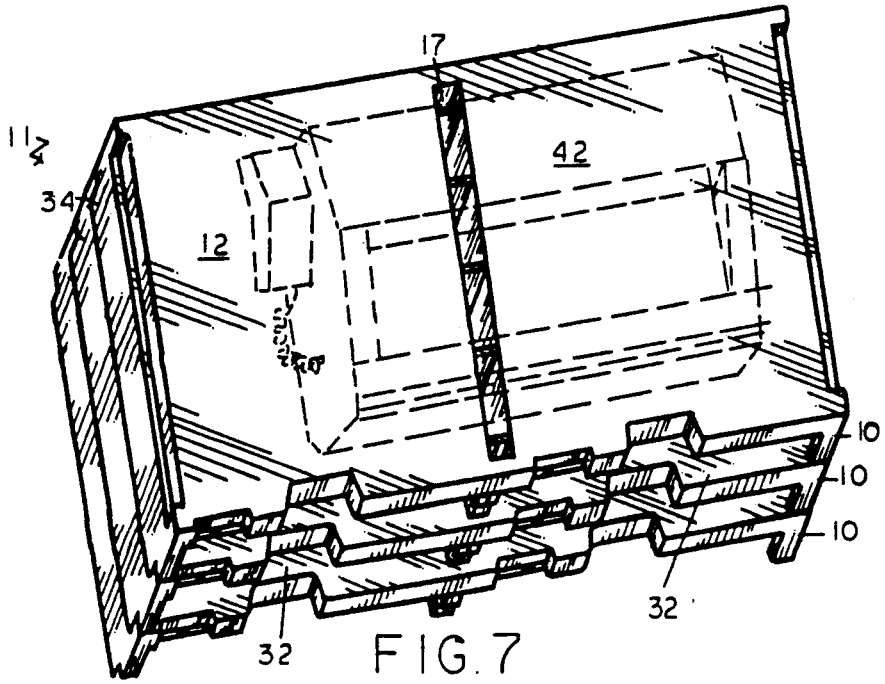
FIG. 7 is a perspective view of the apparatus of the invention of FIG. 1 in use in a 3-stack arrangement with the facsimile machine shown in dotted lines on the top surface.

As shown in FIG. 7, the shelf storage apparatus 11 comprises a plurality of body units 10 stacked together in a 3-stack arrangement with a facsimile machine 42 shown in dotted lines on the top surface 12 wherein the elongated slot 17 of the second body unit 10 provided in the flat top surface 12 is adapted to receive the hollow finger 30 of the next adjacent first body unit 10 in interlocking engagement and to enclose a plurality of documents storage spaces 32, and the elongated side finger elements 34 of the first and second sides 14 to fit into the elongated inwardly extending groove 16 of the next lower body unit 10 in interlocking relationship to provide an interlockable stackable modular shelf and a document storage apparatus 11 having a plurality of document storage spaces and a unitary top shelf for mounting a facsimile machine 42 shown in dotted lines.

What is claimed is:

1. A molded plastic, modular, stackable shelf document storage unit which is adapted to be interlockable and stackable together with other units to provide a top shelf for the placement of a facsimile apparatus or other document producing apparatus and a plurality of stacked letter size storage units beneath the top surface, which unit comprises;

a) a body unit having a generally flat top surface, a first and second short downwardly extending sides and a short downwardly extending back, and having an open front to define an open space within the body unit;

b) the body unit having a short downwardly extending hollow finger from the top surface to divide the open space into a plurality of document receiving storage spaces with an open front;

c) the top surface having an elongated slot therein formed by the hollow finger, the hollow finger of one unit adapted to fit in an interlocking engagement with the elongated slot of the next lower unit to form the document receiving storage spaces; and d) the first and second sides having elongated, downwardly extending side finger elements less than the width of the sides, and the top surface having an elongated, inwardly extending angled groove at the intersection of the top surface and the first and second sides. The first and second side finger elements adapted to fit in interlockable engagement with the first and second grooves of the next lower unit to form together the interlockable, stackable modular shelf and document storage apparatus.

2. The body unit of claim 1 having a short downwardly extending central hollow finger extending from the top surface to divide the open space into a plurality of document receiving storage spaces with an open front adapted to fit on a flat supporting surface to form the document receiving storage spaces.

3. The body unit of claim 1 wherein the body unit has an open back.

4. The body unit of claim 1 which includes a plurality of indent means on the front of the top surface of the body unit to receive identification labels on each of the document receiving storage spaces.

5. The body unit of claim 1 which includes a plurality of access slot means on the front of the top surface of the body unit to permit a use to insert and retrieve documents from each of the document receiving storage spaces.

6. The body unit of claim 1 wherein the elongated slot includes a plurality of transverse struts therein to form a mount for the receipt of the hollow finger of the next higher body unit.

7. The body unit of claim 6 wherein the top surface of the transverse struts are co-planar with the horizontal surface of the angled groove.

8. The body unit of claim 1 wherein the hollow finger is generally centrally positioned and extends substantially transversely the width of the body unit and the angled groove comprises a right angled groove with the side finger elements extending substantially transversely the width of the body unit.

9. The body unit of claim 1 wherein the hollow finger is inwardly offset a short distance at the lower end thereof, the offset matingly engaged to fit into the elongated slot of the next lower body unit.

10. The body unit of claim 1 which includes mounted on the top surface thereof a facsimile machine.

11. A stacked shelf document storage system which comprises a plurality of vertically stacked and interlocked storage units of claim 1.

12. A stacked shelf document storage system of claim 11 which on the top surface there is a facsimile machine.

13. A molded plastic, modular, stackable shelf document storage unit which is adapted to be interlockable and stackable together with other units to provide a top shelf for the placement of a facsimile apparatus or other document-producing apparatus and a plurality of stacked letter size storage units beneath the top surface, which unit comprises:

a) a body unit having a generally flat top surface, a first and second short downwardly extending sides and a short downwardly extending back, and having a front to define an open space within the body unit;

b) the body unit having a short, central, hollow finger downwardly extending from the top surface, the hollow finger extending substantially transversely the width of the body unit to divide the open space into a plurality of document receiving storage spaces with an open front;

c) the top surface having an elongated slot therein formed by the hollow finger, the elongated slot having a plurality of transverse struts therein, the hollow finger of one unit adapted to fit in an interlocking engagement with the elongated slot and to be mounted on the transverse struts of the next lower unit to form the document receiving storage spaces;

d) a plurality of access slot means on the front of the top surface of the body unit to permit a user to insert and retrieve documents from each of the document receiving storage spaces; and e) the first and second sides having elongated, downwardly extending side finger elements extending substantially transversely the width of the body unit and less than the width of the sides, and the top surface having an elongated, inwardly extending, right angled, open groove at the intersection of the top surface and the first and second sides, the first and second side finger elements adapted to fit in interlockable engagement with the first and second grooves of the next lower unit to form together the interlockable, stackable modular shelf and document storage apparatus.

14. A stacked shelf document storage system which comprises a plurality of vertically stacked and interlocked storage units of claim 13.

* * * * *